US005657521A

United States Patent [19]

Gwon et al.

[11] Patent Number: 5,657,521

[45] Date of Patent: Aug. 19, 1997

[54] METHOD FOR MANUFACTURING SUEDE-LIKE WOVEN FABRICS

[75] Inventors: Young Taek Gwon, Seoul; Young Soo Oh; Bo Yun Choi, both of Gyunggi-do; Byoung In Hong, Daejeon-si; Jong Man Lee, Gyunggi-do, all of Rep. of Korea

[73] Assignee: Sunkyong Industries, Gyunggi-do, Rep. of Korea

[21] Appl. No.: 598,430

[22] Filed: Feb. 8, 1996

[30] Foreign Application Priority Data

Jun. 20, 1995 [KR] Rep. of Korea ..... 95-16394

[51] Int. Cl.[6] ..... B32B 33/00; D06H 7/22

[52] U.S. Cl. ..... 28/168; 428/85; 428/91; 428/198

[58] Field of Search ..... 28/159, 162, 168; 428/85, 91

[56] References Cited

U.S. PATENT DOCUMENTS

| | | | |
|---|---|---|---|
| 3,516,239 | 6/1970 | Fukuda et al. | 28/168 X |
| 4,008,344 | 2/1977 | Okamoto et al. | 28/168 X |
| 4,103,054 | 7/1978 | Okamoto et al. | 28/168 X |
| 4,136,221 | 1/1979 | Okamoto et al. | 28/168 X |
| 4,206,257 | 6/1980 | Fukushima et al. | 28/168 X |
| 4,364,983 | 12/1982 | Brücher et al. | 28/168 X |
| 4,485,535 | 12/1984 | Oishi | 28/168 X |
| 5,392,500 | 2/1995 | Orly et al. | 28/168 |

*Primary Examiner*—John J. Calvert

*Attorney, Agent, or Firm*—Oblon, Spivak, McClelland, Maier & Neustadt, P.C.

[57] ABSTRACT

A suede-like woven fabric exhibiting a superior resilient elasticity and superior bulkiness may be obtained by a method in which an ultrafine filament yarn, which contains sea and island components having considerably different solubilities to alkali, is mixed with a hollow, high-shrinkable yarn having a greater fineness than the ultrafine filament yarn. The mixed yarn is used as warp and/or weft, thereby obtaining a gray which is then treated to eliminate easy-soluble components. After completing such a micronization, the gray is subjected to a continuous process including a sanding treatment and a dyeing treatment.

6 Claims, 1 Drawing Sheet

METHOD FOR MANUFACTURING SUEDE-LIKE WOVEN FABRICS

BACKGROUND OF THE INVENTION

1. Field of the Invention

The present invention relates to a method for manufacturing suede-like woven fabrics, and more particularly to a method for manufacturing a suede-like woven fabric which exhibits a superior resiliency and superior bulkiness, in which an ultrafine filament yarn, which contains sea and island components having considerably different solubilities in alkali, is mixed with a hollow, highly-shrinkable yarn having a greater thickness than the ultrafine filament yarn. The mixed yarn is used as warp and/or weft, thereby obtaining a grey fabric which is then treated to eliminate easily-soluble components from the ultrafine filament yarn. After completing the micronization, the grey fabric is subjected to a continuous process including a sanding treatment and a dyeing treatment.

2. Description of the Background

Woven fabrics made of micro fibers having a monocomponent yarn thickness of not more than 1 denier have been widely used for clothing, because they exhibit many positive effects such as a smooth touch, softness, good drapery, mild and peculiar brightness effects, a warm feeling, and writing effect, etc.

In order to improve the touch of such woven fabrics used for clothing, various fiber micronizing methods have been proposed which utilize direct spinning or the physical and chemical characteristics of polymers. However, the fiber micronizing method utilizing direct spinning is difficult to apply to the commercial production of woven fabrics, because it is difficult to achieve practical process control for ultrafine filament yarns exhibiting a thickness of not more than 0.1 deniers.

Fiber micronizing methods utilizing the physical and chemical characteristics of polymers include a method involving conjugatively spinning polymers having different interfacial characteristics and then laminating and dividing them by an agent, and a method involving conjugatively spinning a polymer containing an easily-soluble component and a polymer containing a difficulty-soluble component and eliminating the easily-soluble component. Typically, the latter method is applicable to sea and island fibers. This method is also applicable to solution-divided micro fibers.

A variety of woven fabrics are commercially available which are manufactured by mono-component yarns made of laminated and divided micro fibers produced in accordance with the fiber micronizing method utilizing the physical and chemical characteristics of polymers, thereby exhibiting a peculiar surface effect. In this method, however, it is difficult not only to obtain a uniform interface between polymers having different properties at the spinning step, but also to micronize fibers to a certain thickness. After division, the fibers exhibit a degraded flexibility. Furthermore, divided fibers having different properties exhibit different dyeing exhaustion characteristics. In the case of woven fabrics manufactured by mono-component yarns made of micro fibers, it is difficult to obtain a suitable bulkiness.

On the other hand, ultrafine filament yarns made by eliminating one component can exhibit a very soft touch, because they can be micronized to a thickness ranging from 0.01 deniers to 0.001 deniers. However, such micro fibers exhibit a greatly reduced strength after eliminating certain components. The tearing strength is also degraded.

Recently, other methods have been proposed, in which micronizable ultrafine filament yarns are mixed with yarns exhibiting a high shrinkage rate. An example of such a method is disclosed in Japanese Patent Laid-open Publication No. Heisei 3-59167. In accordance with this method, soluble type divided fibers are mixed with yarns exhibiting a high shrinkage rate so that they are used as warps of a woven fabric after being processed. In this case, however, a slippage defect occurs at the surface of the woven fabric if the eliminating rate of the easily-soluble component is larger than 30%. This results in a limited application of the products.

Another method is disclosed in Japanese Patent Laid-open Publication No. Heisei 2-259137. In accordance with this method, soluble type ultrafine filament yarns are pretwisted along with yarns exhibiting a high shrinkage rate and then treated by an air jet texturing instrument to form loops and bulkiness in the raw yarn. In this case, it is possible to obtain improved fiber opening. However, the presence of loops or bulkiness in yarns in the raw state may cause a problem in workability at the preparation and weaving steps. This method also needs a separate air injection device.

Where ultrafine filament yarns are used as effect yarns for different-shrinkage mixed yarns, it is required to increase the covering rate of the ultrafine filament yarns so that the effect of the ultrafine filament yarn exhibited at the surface of the woven fabric can be maximized. The covering degree of ultrafine filament yarns can be increased by using a method for increasing the weight portion of the ultrafine filament yarn in the raw state, namely, the mixed ratio of the ultrafine filament yarns in the different-shrinkage mixed yarns or by using a method for changing the structure of the woven fabric. Where the weight percentage of the ultrafine filament yarn in the raw state is too high, the final woven fabric exhibits poor elasticity. In this case, degraded anti-drape stiffness and stiffness characteristics are exhibited. Such a phenomenon becomes severe in the case of soluble type micro fibers having a high eliminating rate. In this case, the phenomenon results in a wrapping defect of fabrics in sewed goods and the phenomenon that fabrics in contact with each other tend to become attached to each other. As a result, the applicability is very limited.

SUMMARY OF THE INVENTION

Accordingly, it is one object of the present invention to provide novel suede-like woven fabrics which have a reduced tendency to exhibit the above-mentioned problems.

It is another object of the present invention to provide novel suede-like woven fabrics which exhibit superior resiliency and superior bulkiness.

It is another object of the present invention to provide a novel method for preparing such suede-like woven fabrics.

It is another object of the present invention to provide a novel method for preparing suede-like woven fabrics which has a reduced tendency to suffer from the above-mentioned drawbacks of conventional methods foe preparing suede-like woven fabrics.

These and other objects, which will become apparent during the following detailed description, have been achieved by providing a method for manufacturing a suede-like woven fabric, comprising the steps of:

(i) preparing a mixed yarn of (a) a polyester-based multi-filament yarn, namely, a sheath yarn, capable of being micronized to a monofilament thickness of not more than 0.1 deniers and (b) a highly-shrinkable polyester-based multi-filament yarn, namely, a core yarn, having a larger thickness than the sheath yarn;

(ii) weaving a grey fabric using the mixed yarn as a warp and/or a weft; and (iii) then subjecting the gray to a finish treatment;

the method being characterized in that the sheath yarn comprises a multi-filament yarn exhibiting a boiling water shrinkage, measured in the raw state, less than that of the core yarn by at least 5% and a mono-filament thickness of not more than 5 deniers measured before component elimination is carried out in the finish treatment; the multi-filament yarn contains a component, to be eliminated, in an amount corresponding to a weight portion of 30%, based on the total weight of the multi-filament yarn the core yarn comprises a hollow multi-filament yarn exhibiting a mean boiling water shrinkage rate of more than 20%, and the maximum shrinkage rate as expressed by the following equation is generated at the component eliminating step in the finishing step.

$$Smax(\%)>(We\times Rx\times 0.7)/(Wc+We)$$

where,

Smax: Maximum shrinkage rate (%) of the woven fabric;

Wc: Weight percentage of the core yarn in the mixed yarn;

We: Weight percentage of the sheath yarn in the mixed yarn; and

Rx: Weight percentage of the component to be eliminated in the sheath yarn.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
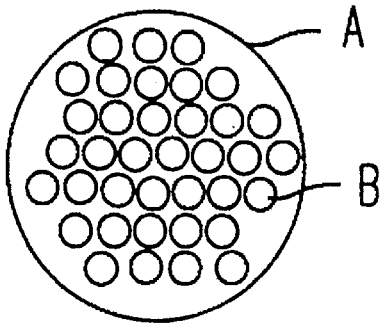
FIG. 1 is a cross-sectional view of a sea/island type ultrafine filament yarn, used as a sheath yarn, before eliminating its sea component.
Figure 2:
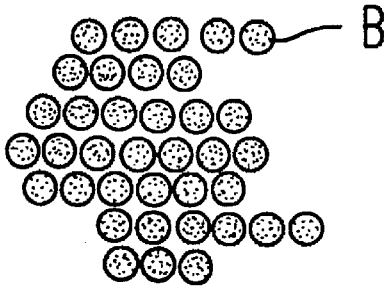
FIG. 2 is a cross-sectional view of the sea/island type ultrafine filament yarn, used as a sheath yarn, after eliminating its sea component.

The method of the present invention is applied to the manufacture of woven fabrics using, as one or both of warp and weft, a mixed yarn of a polyester based muti-filament yarn (sheath yarn) capable of being micronized to a thickness of not more than 0.1 deniers and a highly-shrinkable polyester based multi-filament yarn (core yarn) having a larger thickness than the sheath yarn. In implementing the present invention, it is important to control thermal characteristics of the sheath yarn and core yarn. In the raw state, the core yarn should have a mean boiling water shrinkage rate of more than 20% whereas the sheath yarn should have a mean boiling water shrinkage rate less than that of the core yarn by at least 5%.

When the core yarn has a mean boiling water shrinkage rate of not more than 20%, the raw yarn is insufficiently shrunk during the elimination of easily-soluble component of the sheath yarn, thereby causing the final woven fabric to have a low compactiveness which results in an occurrence of the slippage defect. Furthermore, slippage may occur at a raising step.

On the other hand the woven fabric can exhibit bulkiness only when the shrinkage rate difference between the core yarn and sheath yarn is not less than 5%. With a shrinkage rate difference of less than 5%, the woven fabric reveals insufficient bulkiness.

Where a large amount of filaments of the core yarn is mixed with the sheath yarn because of a small shrinkage-rate difference between the core yarn and sheath yarn, the filaments may be cut or raised upon raising the filaments of the ultrafine filament yarn in a raising step following the elimination of easily-soluble components. As a result, a partial degradation occurs at the cut portion of the core yarn. Moreover, a non-uniformity in dyeability is exhibited due to a large difference in dyeing exhaustion between the ultrafine filament yarn, namely, the sheath yarn and the larger filament yarn, namely, the core yarn. In this regard, it is important that the sheath yarn has a boiling water shrinkage rate less than that of the core yarn by at least 5%.

The thickness of each yarn constituting the mixed yarn is also important for a desired resiliency of the woven fabric and a required workability at the yarn mixing step. In the case of a woven fabric manufactured only by ultrafine filament yarns, it exhibits an insufficient elasticity resulting in various drawbacks. In this case, there is a wrapping defect of fabrics in sewed goods such as clothing and the phenomenon that fabrics in contact with each other tend to become attached to each other. It, therefore, is apparent that such undesirable phenomena have a close relation with the fineness of the yarn.

In this connection, a hollow yarn with a large thickness of not less than 2 deniers should be used as the core yarn in accordance with the present invention. After testing, it was found that a woven fabric manufactured from yarns having a hollow cross-section is superior than that manufactured from yarns of the same thickness, but having no hollow cross-section, in terms of the elasticity. It was also found that of hollow yarns, those having a larger hollowness exhibit a superior elasticity. For such hollow yarns, it is important to form a hollow tube structure having no broken portion. In accordance with the present invention, a hollow yarn having a hollowness of not less than 2% is preferred. A hollow yarn with a large thickness of not more than 7 deniers is especially preferred as the core yarn. Where a core yarn having too high a mono-filament thickness is mixed with a sheath yarn using an air interlacing method, poor mixing may be generated. As the sheath yarn, it is preferred to use a yarn having a thickness of not more than 5 deniers. This is because the sheath yarn has a close relation with the mono-filament thickness obtained after the micronization as well as the poor mixing. When a yarn of more than 5 deniers is used as the sheath yarn, the mono-filament thickness obtained after the elimination is too large. In this case, a degradation in the fabric touch occurs.

On the other hand, the mixing of two raw yarns, namely, the sheath yarn and core yarn can be carried out using an air interlacing method. Alternatively, it may be achieved by doubling and twisting the yarns in the winding or preparing step. In the former case, it is important to prevent loops or fibrils from being formed on the yarns in the raw state. In the latter case, it is important to determine the appropriate number of twists. A too large number of twists results in a degradation in bulkiness. It is preferred that the number of twist ranges from 200 T/m to 1,500 T/m, where T/m is twists per meter.

In accordance with the present invention, it is also preferred that the sheath yarn have a content of components to be eliminated of more than 30% by weight, based on the weight of the sheath yarn. When the amount of eliminated components is reduced to a level corresponding to a weight portion of not more than 30% as either the number of island components contained in a mono filament, or the number of divided segments is increased in the manufacture of sheath yarns having a fineness of not more than 0.1 deniers, there is the possibility that adjacent difficultly-soluble components may internally flame-bonded to each other, even though no slippage defect occurs by virtue of a small reduction in the compactiveness of the woven fabric exhibited after the elimination of easily-soluble components in a subsequent step. The internal flame-bonding of difficultly-soluble components results in a thickness deviation of the ultrafine filaments in the final woven fabric. A difference in dyeing exhaustion may also occur between larger filaments. This may cause a non-uniformity in dyeability.

For raw yarn-constituted by the mixed ultrafine filaments, the mixing ratio between the sheath yarn and core yarn is also important with respect to the covering factor of the final woven fabric. When being expressed by the weight portion, the mixing ratio between the sheath yarn and core yarn is preferred to be 3:2 to 1:3. When the weight portion of the core yarn is less than 25% the final woven fabric exhibits a degraded tearing strength, even though the covering effect thereof provided by the ultrafine filaments is improved. When the weight portion is more than 60%, the softness peculiarly provided by the ultrafine filaments is insufficiently exhibited.

In weaving a woven fabric, the above-mentioned mixed yarn can be used as warp and/or weft. This raw yarn may be used alone or mixed with a routine yarn.

After completing the weaving, scouring and eliminating steps are carried out. In this case, it is important to control the steps such that a maximum shrinkage is exhibited at the eliminating step. In the case of a woven fabric manufactured by a mixed yarn constituted by yarns exhibiting different shrinkage rates, such a maximum shrinkage is exhibited at the scouring step. It is preferred that scouring and relaxing the woven fabric are carried out at the lowest temperature possible in a short time. In this case, it is possible to obtain a woven fabric exhibiting a superior compactiveness even after removing the components to be eliminated at the eliminating step. With respect to the content of the component to be eliminated, the maximum shrinkage rate should satisfy the following equation (1):

$$Smax(\%)>(We\times Rx\times 0.7)/(Wc+We) \quad (1)$$

where,

Smax: Maximum shrinkage rate (%) of the woven fabric;

Wc: Weight percentage of the core yarn in the mixed yarn;

We: Weight percentage of the sheath yarn in the mixed yarn; and

Rx: Weight percentage of the component to be eliminated in the sheath yarn.

Independently of the maximum shrinkage exhibition, the alkali concentration, the treatment time, and the treatment temperature in the eliminating step for the ultrafine filament yarn should be appropriately determined so that a uniform elimination can be obtained.

Other features of the invention will become apparent in the course of the following descriptions of exemplary embodiments which are given for illustration of the invention and are not intended to be limiting thereof.

EXAMPLES

Examples 1 to 3 and Comparative Examples 1 to 9

In all the examples and comparative examples, the boiling water shrinkage rate (BWS) of yarn was measured using the following equation:

$$BWS(\%)=[(L2-L1)/L1]\times 100$$

where,

L1: Length of the raw yarn measured after a load of 0.1 g/de is applied to the raw yarn; and L2: Length of the raw yarn measured after treating the raw yarn in a boiling water for 30 minutes while applying a load of 2 mg/de thereto, naturally drying it for 24 hours and then applying a load of 0.1 g/de to the dried yarn.

A sea/island mixed polyester fiber having a cross-sectional shape shown in FIG. 1 and exhibiting an eliminated component weight portion of 33% by weight was spun at a rate of 1300 m/min. The fiber was then drawn at a winding speed of 400 m/min at a draw ratio of 2.90. The drawn fiber was heattreated at a temperature of 200° C. and then wound, thereby forming a sheath yarn having an elongation of 40%. The BWS and thickness of the sheath yarn are shown in Table 1.

Figure 3A:
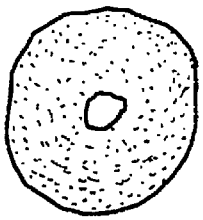
FIG. 3A is a cross-sectional view of a hollow, high-shrinkable yarn, used as a core yarn, showing a circular cross-section of the yarn.
Figure 3B:
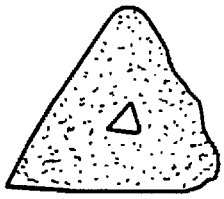
FIG. 3B is a cross-sectional view of hollow, high-shrinkable yarn, used as a core yarn, showing a triangular cross-section of the yarn.

Also, a hollow highly-shrinkable polyester fiber having a cross-sectional shape shown in FIG. 3 and exhibiting a hollowness shown in Table 1 was spun at a rate of 1,900 m/min. The fiber was then drawn at a winding speed of 700 m/min and draw ratio of 2.57. The drawn fiber was heat-treated at a temperature of 200° C. and then wound, thereby forming a core yarn having an elongation of 30%. The BWS and thickness of the sheath yarn are also shown in Table 1.

Thereafter, the two multi-filament yarns made in accordance with the above method were mixed together using a separate air jetting device. The mixed yarn was twisted at a rate of 400 twists/m and then sized at a temperature of 90° C. to prepare a warp. A polyester 75 denier/72-filament draw-textured yarn was false-twisted in a rate of 1,800 twists/m to prepare a weft. After weaving these-warp and weft, a grey fabric was obtained which had a warp density of 152 yarns/1 in. and a weft density of 72 yarns/1 in.

This gray was subjected to a scouring and relaxing heat treatment in a rotating washer for 15 minutes and then to an alkali treatment using caustic soda in an amount of 20 g/1 at a temperature of 120° C. for 20 minutes.

The shrinkage rates exhibited after the scouring treatment and the eliminating treatment, respectively, are shown in Table 1. The different-shrinkage mixed woven fabric, which exhibited a thickness of 0.06 deniers after the eliminating treatment, was subjected to a raising treatment using a sand paper and then to a dyeing treatment. Thus, a suede-like woven fabric was obtained.

The physical properties of the suede-like woven fabric are shown in Table 2.

TABLE 1

| | Sheath Yarn | | | | Core Yarn | | | Shrinkage Rate | |
|---|---|---|---|---|---|---|---|---|---|
| | Total Thickness (denier) | Mono-filament Thickness (denier) | Hollow-ness (%) | BWS (%) | Total Thickness (denier) | Mono-Filament Thickness (denier) | BWS (%) | Relax-ing (%) | Elimi-nation (%) |
| Ex. 1 | 48 | 2 | 5 | 32 | 100 | 3.3 | 10 | 21 | 25 |
| Ex. 2 | 48 | 4 | 3 | 40 | 100 | 3.3 | 10 | 21 | 30 |
| Ex. 3 | 48 | 4 | 3 | 40 | 100 | 3.3 | 10 | 21 | 31 |
| Com. 1 | 50 | 0.5 | 0 | 35 | 100 | 3.3 | 10 | 16 | 24 |
| Com. 2 | 50 | 0.5 | 3 | 37 | 100 | 3.3 | 10 | 18 | 26 |
| Com. 3 | 50 | 0.5 | 5 | 40 | 100 | 3.3 | 10 | 17 | 22 |
| Com. 4 | 48 | 1 | 3 | 25 | 100 | 3.3 | 10 | 20 | 25 |
| Com. 5 | 48 | 2 | 0 | 35 | 100 | 3.3 | 10 | 18 | 23 |
| Com. 6 | 48 | 2 | 5 | 15 | 100 | 3.3 | 10 | 20 | 24 |
| Com. 7 | 48 | 4 | 3 | 40 | 100 | 3.3 | 10 | 23 | 20 |
| Com. 8 | 48 | 4 | 3 | 40 | 150 | 5.0 | 10 | 21 | 30 |
| Com. 9 | 48 | 4 | 3 | 40 | 100 | 3.3 | 36 | 22 | 29 |

*The monofilament fineness of the sheath yarn was measured before the elimination of the sea component

TABLE 2

| | Effect of Fabric | | | |
|---|---|---|---|---|
| | Bulkiness | Resiliency | Compativeness | Remark |
| Ex. 1 | ○ | ⊙ | ○ | |
| Ex. 2 | ⊙ | ⊙ | ⊙ | |
| Ex. 3 | ⊙ | ⊙ | ⊙ | |
| Com. 1 | ○ | X | Δ | |
| Com. 2 | ○ | Δ-X | ○ | |
| Com. 3 | ⊙ | Δ | Δ | |
| Com. 4 | Δ | Δ | ○ | |
| Com. 5 | ○ | Δ | Δ | |
| Com. 6 | Δ | ○ | ○ | |
| Com. 7 | ○ | ⊙ | Δ | |
| Com. 8 | ⊙ | ⊙ | ⊙ | Poor Treatment (twisting) |
| Com. 9 | Δ | ⊙ | ○ | |

⊙: Excellent ○: Good Δ: Normal X: Poor

*In comparative Example 7, the fabric had a degraded compactiveness and a poor appearance because the maximum shrinkage was exhibited before the elimination of components.

Referring to Table 2, it can be seen that suede-like woven fabrics exhibiting a high resiliency and a high bulkiness and exhibiting no slippage were obtained in all the examples according to the present invention.

This application is based on Korean Patent Application No. 95-16394 filed in Jun. 20, 1995, in the Republic of Korea and which is incorporated herein by reference in its entirety.

Obviously, numerous modifications and variations of the present invention are possible in light of the above teachings. It is therefore to be understood that, within the scope of the appended claims, the invention may be practiced otherwise than as specifically described herein.

What is claimed as new and is desired to be secured by Letters Patent of the United States is:

1. A method for manufacturing a suede-like woven fabric, comprising the steps of:

(i) preparing a mixed yarn of (a) a sheath yarn comprising a polyester-based multi-filament yarn having a mono-filament thickness of not more than 5 deniers and comprising a component to be eliminated, in an amount of 30% by weight, based on the weight of said multi-filament yarn, capable of being micronized to a mono-filament thickness of not more than 0.1 deniers by component elimination and (b) a core yarn comprising a hollow and highly-shrinkable polyester-based multi-filament yarn having a larger thickness than said sheath yarn, wherein said sheath yarn exhibits a boiling water shrinkage rate (BWS, in percent), expressed by the following equation (I), less than that of said core yarn by at least 5% and said core yarn exhibits a boiling water shrinkage rate, expressed by the following equation (I), of more than 20%:

$$BWS(\%)=[(L2-L1)/L1]\times 100 \quad \text{(I)}$$

where,

L1 is the length of the yarn measured after a load of 0.1 g/de is applied to the yarn; and L2 is the length of the yarn measured after treating the yarn in boiling water for 30 minutes while applying a load of 2 mg/de thereto, naturally drying it for 24 hours and then applying 0.1 g/de to the dried yarn, (ii) weaving said mixed yarn as a warp, a weft, or both to obtain a grey fabric; and (iii) scouring and relaxing said grey fabric and then eliminating said component to be eliminated from said sheath yarn by alkali treatment to generate a maximum shrinkage rate (Smax, in percent) as expressed by the following equation (II), $$Smax(\%)>(We\times Rx\times 0.7)/(Wc+We) \quad \text{(II)}$$

where,

Smax is the maximum shrinkage rate (%) of said woven fabric;

Wc is the weight percentage of said core yarn in said mixed yarn;

We is the weight percentage of said sheath yarn in said mixed yarn; and

Rx is the weight percentage of said component to be eliminated, in said sheath yarn.

2. The method of claim 1, wherein said core yarn has a mono-filament thickness ranging from 2 denires to 7 denires.

3. The method of claim 1, wherein said core yarn has a hollowness of not less than 2%.

4. A suede-like woven fabric, prepared by a method comprising the steps of:

(i) preparing a mixed yarn of (a) a sheath yarn comprising a polyester-based multi-filament yarn having a mono filament thickness of not more than 5 deniers and comprising a component to be eliminated, in an amount of 30% by weight, based on the weight of said multi-filament yarn, capable of being micronized to a mono-filament thickness of not more than 0.1 deniers by component elimination and (b) a core yarn comprising a hollow and highly-shrinkable polyester-based multi-filament yarn having a larger thickness than said sheath yarn, wherein said sheath yarn exhibits a boiling water shrinkage rate (BWS, in percent), expressed by the following equation (I), less than that of said core yarn by at least 5% and said core yarn exhibits a boiling water shrinkage rate, expressed by the following equation (I), of more than 20%:

$$BWS(\%)=[(L2-L1)/L1]\times 100 \quad (I)$$

where,

L1 is the length of the yarn measured after a load of 0.1 g/de is applied to the yarn; and L2 is the length of the yarn measured after treating the yarn in boiling water for 30 minutes while applying a load of 2 mg/de thereto, naturally drying it for 24 hours and then applying 0.1 g/de to the dried yarn, (ii) weaving said mixed yarn as a warp, a weft, or both to obtain a grey fabric; and (iii) scouring and relaxing said grey fabric and then eliminating said component to be eliminated from said sheath yarn by alkali treatment to generate a maximum shrinkage rate (Smax, in percent) as expressed by the following equation (II), $$Smax(\%)>(We\times Rx\times 0.7)/(Wc+We) \quad (II)$$

where,

Smax is the maximum shrinkage rate (%) of said woven fabric;

Wc is the weight percentage of said core yarn in said mixed yarn;

We is the weight percentage of said sheath yarn in said mixed yarn; and

Rx is the weight percentage of said component to be eliminated, in said sheath yarn.

5. The suede-like woven fabric of claim 4, wherein said core yarn has a mono-filament thickness ranging from 2 deniers to 7 deniers.

6. The suede-like woven fabric of claim 4, wherein said core yarn has a hollowness of not less than 2%.

* * * * *